US007506787B2

(12) United States Patent
Wu et al.

(10) Patent No.: US 7,506,787 B2
(45) Date of Patent: Mar. 24, 2009

(54) NAIL-DRIVING DEVICE WITH SAFETY UNIT

(75) Inventors: Chien-Jung Wu, Taichung (TW); Tsung-Min Hsu, Taichung (TW); Yi-Peng Lin, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/832,061

(22) Filed: Aug. 1, 2007

(65) Prior Publication Data

US 2008/0135596 A1 Jun. 12, 2008

(30) Foreign Application Priority Data

Dec. 8, 2006 (TW) ..... 095145967 A

(51) Int. Cl.
*B25C 1/04* (2006.01)

(52) U.S. Cl. ..... 227/8; 227/120

(58) Field of Classification Search ..... 227/8, 227/120, 121

See application file for complete search history.

(56) References Cited

U.S. PATENT DOCUMENTS 3,563,438 A * 2/1971 Doyle et al. ..... 227/8
4,197,974 A * 4/1980 Morton et al. ..... 227/8
4,463,888 A * 8/1984 Geist et al. ..... 227/109
4,597,517 A * 7/1986 Wagdy ..... 227/8
5,803,338 A * 9/1998 Singer et al. ..... 227/8
6,149,046 A * 11/2000 Ho et al. ..... 227/8
6,199,739 B1 * 3/2001 Mukoyama et al. ..... 227/8
6,209,770 B1 * 4/2001 Perra ..... 227/8
6,966,476 B2 * 11/2005 Jalbert et al. ..... 227/8
6,966,477 B1 * 11/2005 Chien-Kuo et al. ..... 227/8
7,000,294 B2 * 2/2006 Kakuda et al. ..... 227/120
7,032,794 B1 * 4/2006 Hung et al. ..... 227/8
2004/0149800 A1 * 8/2004 Perra et al. ..... 227/8
2004/0222266 A1 * 11/2004 Kakuda et al. ..... 227/8
2006/0249554 A1 * 11/2006 Butzen et al. ..... 227/130

* cited by examiner

*Primary Examiner*—Brian D Nash
(74) *Attorney, Agent, or Firm*—Muncy, Geissler, Olds & Lowe PLLC

(57) ABSTRACT

A nail-driving device has a housing, a trigger unit, a safety unit, a connecting unit and a magazine. The safety unit has first and second safety members in the housing. The connecting unit is connected pivotally to the second safety member, and has a retaining portion disposed movably between the first and second safety members. The magazine has a pusher for pushing nails therein. When the retaining portion is in a retaining position, a force is applicable to the first safety member to move the second safety member to pivot a trigger arm for a nail-driving operation when the trigger unit is actuated. When the nails thereof are exhausted, the pusher moves to a retention releasing position to pivot the connecting unit and remove the retaining portion from the retaining position to allow for relative movement of the first and second safety members to prevent the nail-driving operation.

10 Claims, 11 Drawing Sheets

NAIL-DRIVING DEVICE WITH SAFETY UNIT

CROSS-REFERENCE TO RELATED APPLICATION

This application claims priority of Taiwanese Application No. 095145967, filed on Dec. 8, 2006.

BACKGROUND OF THE INVENTION

1. Field of the Invention

This invention relates to a nail-driving device, and more particularly to a nail-driving device with a safety unit cooperating with a pusher for preventing the nail-driving device from firing when nails are exhausted from a magazine of the nail-driving device.

2. Description of the Related Art

Referring to FIG. 1, a conventional nail-driving device 1 includes a housing 11, a magazine 12, and a rigid safety rod 13. The housing 11 includes a handle 111, an air cylinder 112, a nail ejection seat 113, and a plunger 114. The plunger 114 is disposed movably on the handle 111. A trigger 116 is disposed pivotally on the housing 11. A trigger arm 115 is mounted pivotally on a free end portion of the trigger 116. The magazine 12 is connected to the nail ejection seat 113, and includes a row of nails (not shown), a pusher 121 for pushing the nails into the nail ejection seat 113 one at a time, and a projection 122 extending toward the nail ejection seat 113. The safety rod 13 is disposed movably in the housing 11, and has a workpiece-engaging end 131 projecting from the nail ejection seat 113, and a trigger-engaging end 132 opposite to the workpiece-engaging end 131. The trigger-engaging end 132 is movable into contact with a free end portion of the trigger arm 115. When the workpiece-engaging end 131 of the safety rod 13 is pressed against a workpiece (not shown), the safety rod 13 moves relative to the housing 11 so that the trigger-engaging end 132 comes into contact with the trigger arm 115. In this state, if the trigger 116 is actuated, the trigger arm 115 will push and move the plunger 114 for performing a nail-driving operation.

When the pusher 121 is moved to a position whereat the pusher 121 is adjacent to the nail ejection seat 113 due to the fact that no nails remain in the magazine 12, a portion of the safety rod 13 is impeded by the projection 122 from movement relative to the housing 11. Hence, the trigger-engaging end 132 cannot contact the trigger arm 115, thereby preventing the nail-driving device from firing.

The aforesaid conventional nail-driving device 1 suffers from a drawback. That is, in a state where the nails are exhausted from the magazine 12, when the workpiece-engaging end 131 of the safety rod 13 is pressed against the workpiece, the above-mentioned portion of the rigid safety rod 13 may strike on the projection 122. If this occurs, since the stroke force of the safety rod 13 against the projection 122 is not buffered, the safety rod 13, the pusher 121, and the workpiece may be damaged.

SUMMARY OF THE INVENTION

The object of this invention is to provide a nail-driving device that includes a safety unit cooperating with a pusher for preventing the nail-driving device from firing when nails are exhausted from a magazine of the nail-driving device, and a buffering arrangement for buffering a stroke force of the safety unit against a pusher.

According to this invention, a nail-driving device includes a housing, a trigger unit, a safety unit, a connecting unit, and a magazine. The safety unit includes first and second safety members disposed movably in the housing. The connecting unit includes a retaining portion disposed movably between the first and second safety members and in a retaining position whereat a force is applicable to the first safety member to move the second safety member to pivot a trigger arm of the trigger unit so as to allow for a nail-driving operation when the trigger unit is actuated. The magazine includes a pusher for pushing and moving nails in the magazine. The pusher is movable to a retention releasing position whereat the retaining portion of the safety unit is removed from the retaining position to thereby allow for relative movement of the first and second safety members so that a main-driving operation is prevented.

When nails are exhausted from the magazine and when the workpiece-engaging end of the safety unit is pressed against the workpiece, since the first and second safety members can move relative to each other, a stroke force of the safety unit against the pusher can be buffered.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
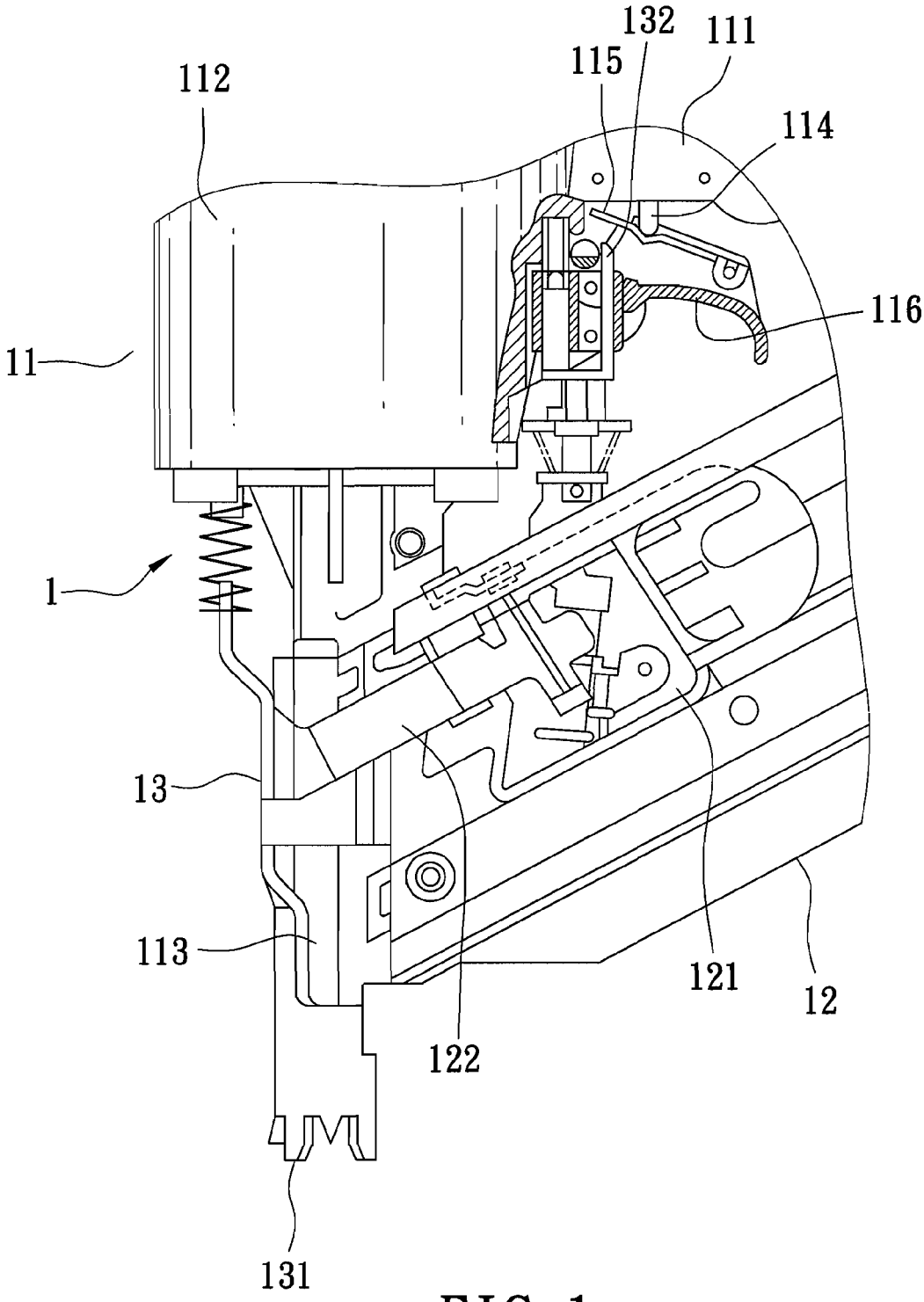
FIG. 1 PRIOR ART
FIG. 1 is a fragmentary, partly exploded schematic front view of a conventional nail-driving device.

Before the present invention is described in greater detail in connection with the preferred embodiments, it should be noted that similar elements and structures are designated by like reference numerals throughout the entire disclosure.

Figure 2:
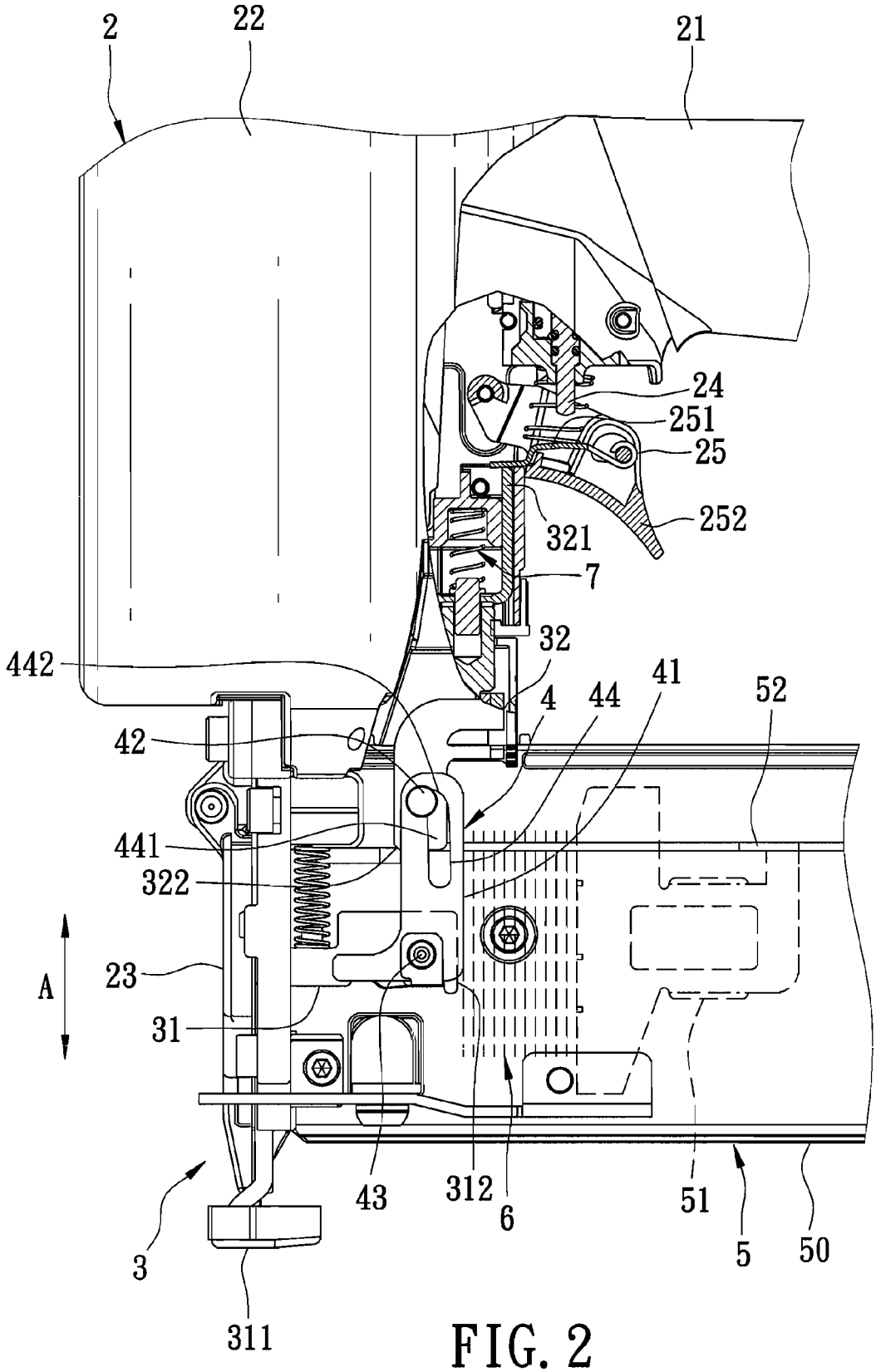
FIG. 2 is a fragmentary, partly exploded schematic front view of the first preferred embodiment of a nail-driving device according to this invention when a retaining portion is disposed in a retaining position.

Referring to FIG. 2, the first preferred embodiment of a nail-driving device according to this invention includes a housing 2, a trigger unit 25, a safety unit 3, a connecting unit 4, and a magazine 5.

The housing 2 includes a handle 21, an air cylinder 22, a nail ejection seat 23 permitting a nail to be shot from the housing 2 therethrough, and a plunger 24. The plunger 24 is disposed movably on the handle 21. The trigger unit 25 includes a trigger arm 251 and a trigger 252. The trigger 252 is disposed pivotally on the housing 2. The trigger arm 251 is mounted pivotally on a free end portion of the trigger 252.

The safety unit 3 includes first and second safety members 31, 32 that are disposed movably in the housing 2 between the trigger unit 25 and the nail ejection seat 23. The first safety member 31 is movable along a nail-driving direction (A), and has a workpiece-engaging end 311 projecting from the nail ejection seat 23, and a driving end 312 opposite to the workpiece-engaging end 311. When the workpiece-engaging end 311 is pressed against a workpiece (not shown), the first safety member 31 is moved toward the trigger unit 3. The second safety member 32 is movable relative to the housing 2 along the nail-driving direction (A), and has a trigger-engaging end 321 biased by a spring 7 to contact a free end of the trigger arm 251 and movable to pivot the trigger arm 251, and a driven end 322 opposite to the trigger-engaging end 321.

Figure 3:
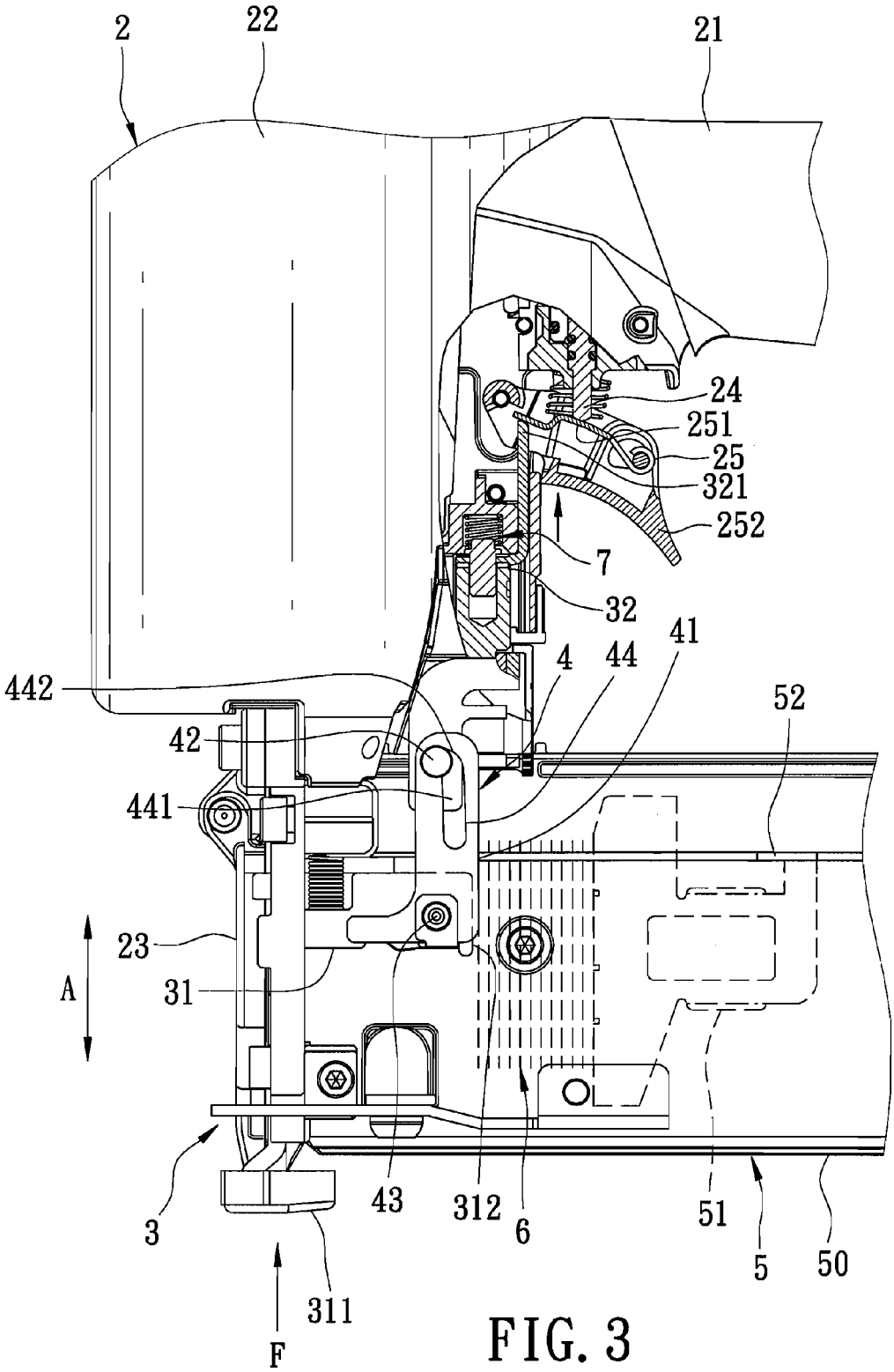
FIG. 3 is a fragmentary, partly exploded schematic front view of the first preferred embodiment in a state ready for driving a nail.
Figure 4:
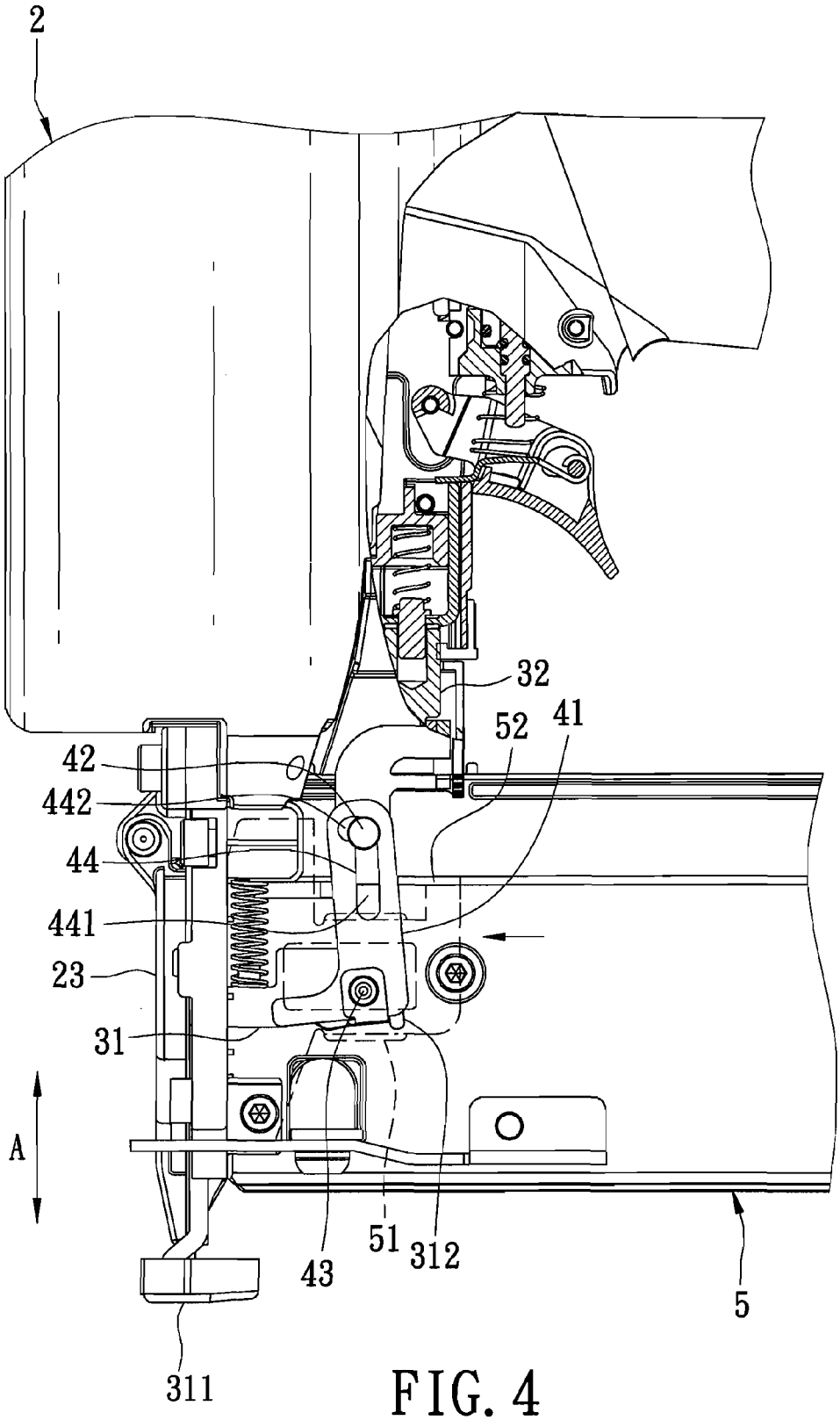
FIG. 4 is a fragmentary, partly exploded schematic front view of the first preferred embodiment, illustrating how the retaining portion is removed from the retaining position when nails are exhausted from a magazine.

The connecting unit 4 includes a connecting member 41, a first pivot member 42, a second pivot member 43, and a retaining portion disposed between the first and second safety members 31, 32. The first pivot member 42 extends through one end of the connecting member 41 and the driven end 322 of the second safety member 32. The second pivot member 43 extends through the other end of the connecting member 41 and the driving end 312 of the first safety member 31. Due to the presence of the first and second pivot members 42, 43, the first and second safety members 31, 32 are interconnected. The connecting member 41 is formed with a slot 44 having a slide section 441 and a stop section 442. The stop section 442 is perpendicular to the slide section 441, has an end connected to an end of the slide section 441, and constitutes the retaining portion of the connecting unit 4. The stop section 442 is disposed in a retaining position whereat the first pivot member 42 engages the stop section 442 so as to prevent relative movement of the first and second safety members 31, 32. In the retaining position, with further reference to FIG. 3, when the workpiece-engaging end 311 of the first safety member 31 is pressed against the workpiece, a force (F) is applied to the first safety member 31 along the nail-driving direction (A). Hence, the trigger-engaging end 321 of the second safety member 32 is moved to pivot the trigger arm 251 to thereby move the plunger 24 so as to allow for a nail-driving operation when the trigger 252 is actuated.

The magazine 5 includes a magazine body 50 connected to the nail ejection seat 23 of the housing 2 for receiving a plurality of nails 6 therewithin, and a pusher 51 for pushing and moving the nails 6 toward the nail ejection seat 23. The pusher 51 is formed with a projection 52 projecting from the magazine body 50 toward the nail ejection seat 23.

Figure 5:
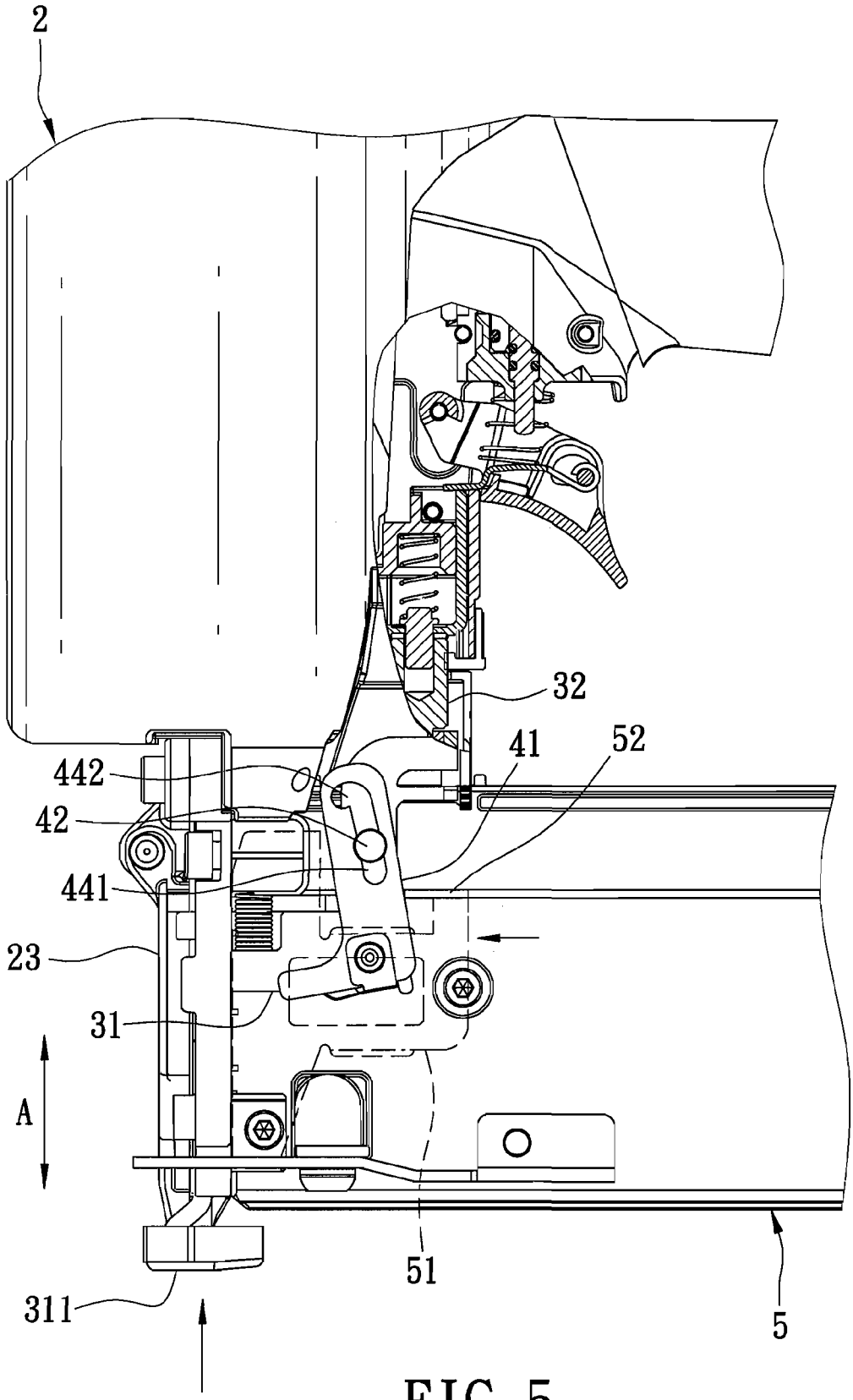
FIG. 5 is a fragmentary, partly exploded schematic front view of the first preferred embodiment, illustrating how a nail-driving operation is prevented when nails are exhausted from a magazine.

When the nails 6 are exhausted from the magazine 5, the pusher 51 is moved to a retention releasing position shown in FIG. 5. Hence, the projection 52 of the pusher 51 contacts and pivots the connecting member 41 about the second pivot member 43 to thereby remove the retaining portion (i.e., the stop portion 442 of the slot 44 in the connecting member 41) from the retaining position. Stated differently, the first pivot member 42 is moved from the stop section 442 of the slot 44 into the slide section 441 of the slot 44. In this state, with further reference to FIG. 5, when the workpiece-engaging end 311 of the first safety member 31 is pressed against the workpiece to move upwardly relative to the housing 2, the first pivot member 42 is moved downwardly into a middle portion of the slot 44, thereby allowing for relative movement of the first and second safety members 31, 32. At this time, since movement of the second safety member 32 relative to the housing 2 is allowed, actuation of the trigger 252 does not result in a nail-driving operation. Thus, the user can realize a need for nail replenishment as a result of the misfire that occurs after actuation of the trigger 252.

As such, when nails 6 are exhausted from the magazine 5 and when the workpiece-engaging end 311 of the first safety member 31 is pressed against the workpiece, since the first and second safety members 31, 32 can move relative to each other, a stroke force of the first safety member 31 against the pusher 51 can be buffered. Thus, when the first safety member 31 comes into contact with the pusher 51, damage to the first safety member 31, the pusher 51, and the workpiece can be minimized.

Figure 6:
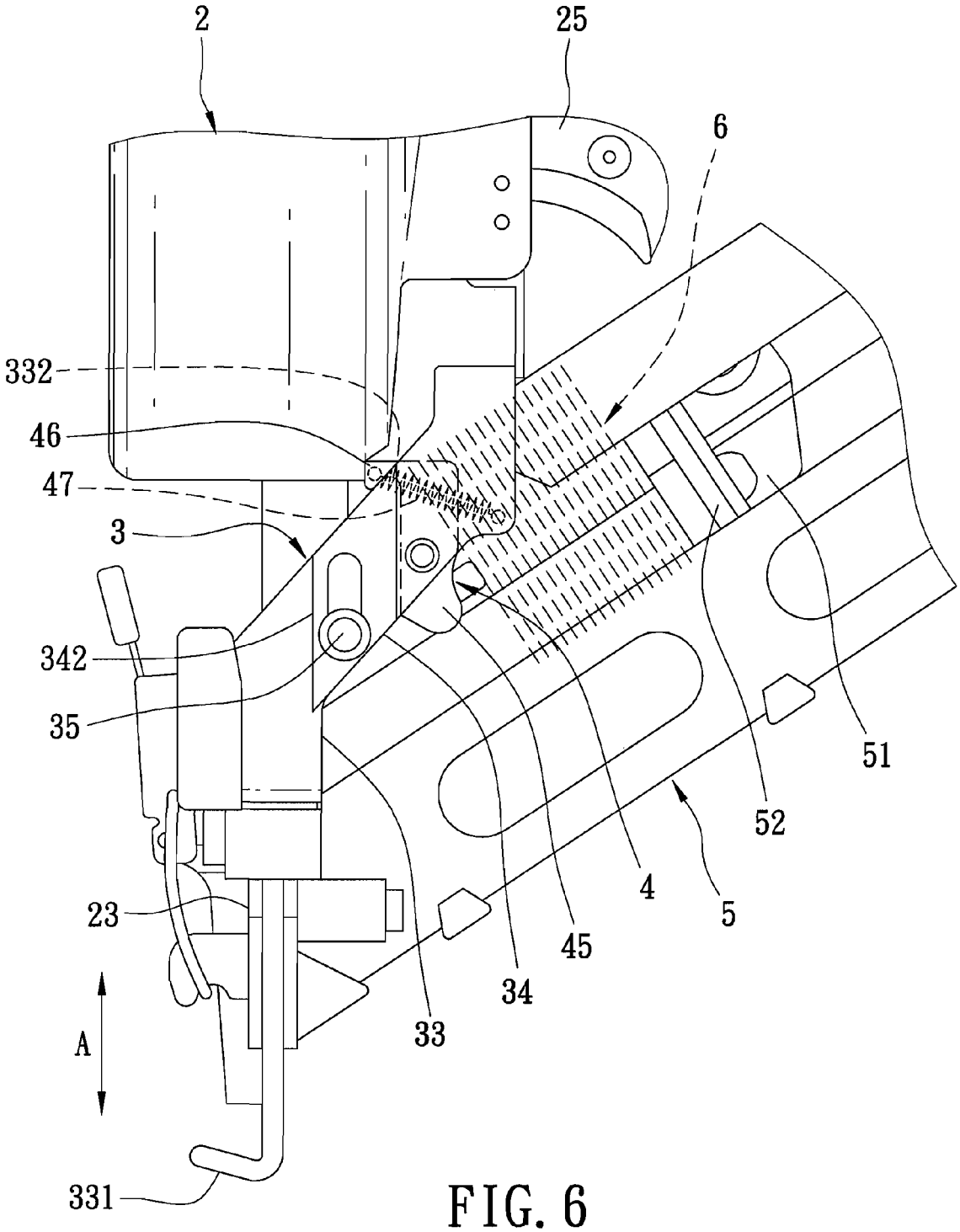
FIG. 6 is a fragmentary, partly exploded schematic front view of the second preferred embodiment of a nail-driving device according to this invention when a retaining portion is disposed in a retaining position.
Figure 7:
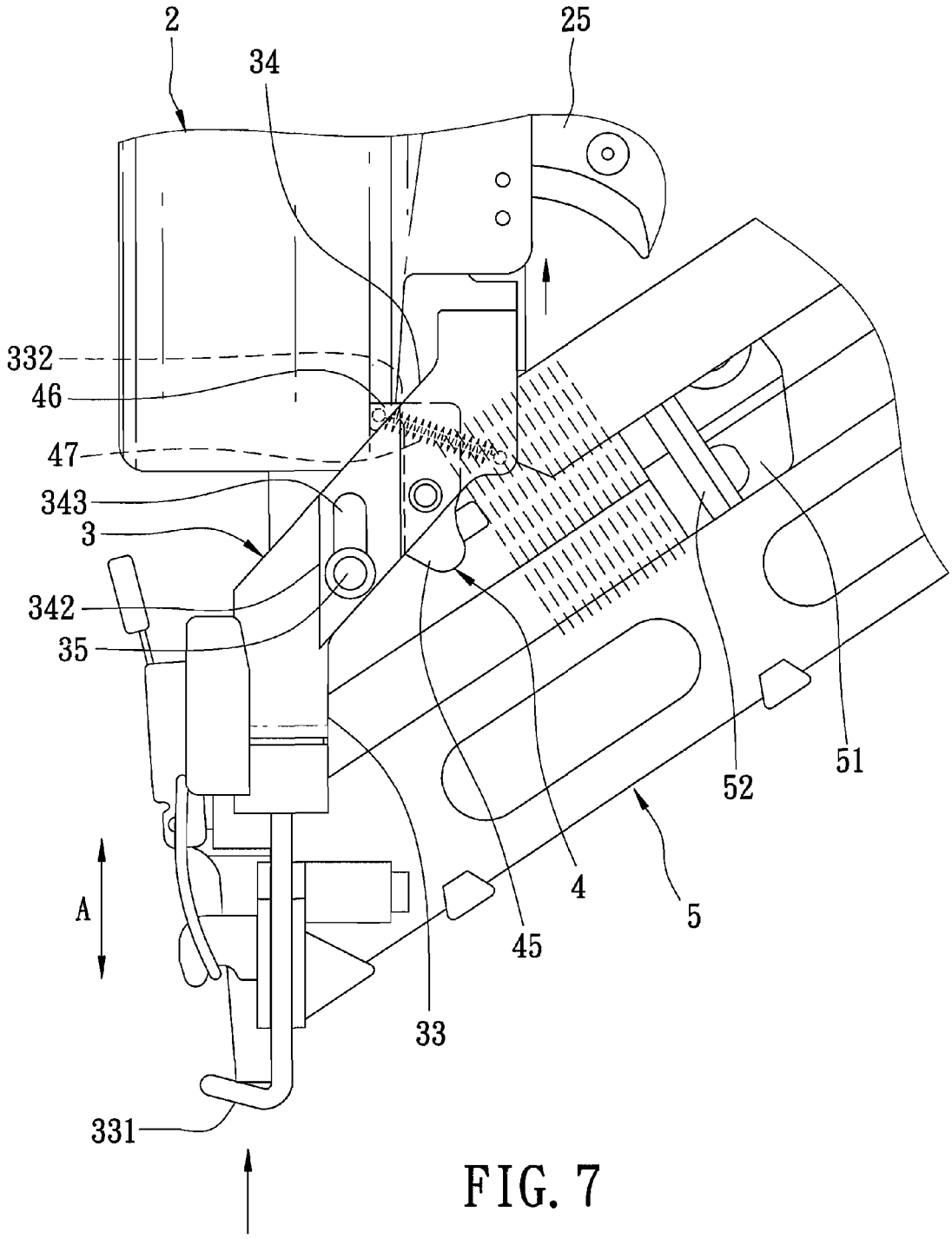
FIG. 7 is a fragmentary, partly exploded schematic front view of the second preferred embodiment in a state ready for driving a nail.
Figure 8:
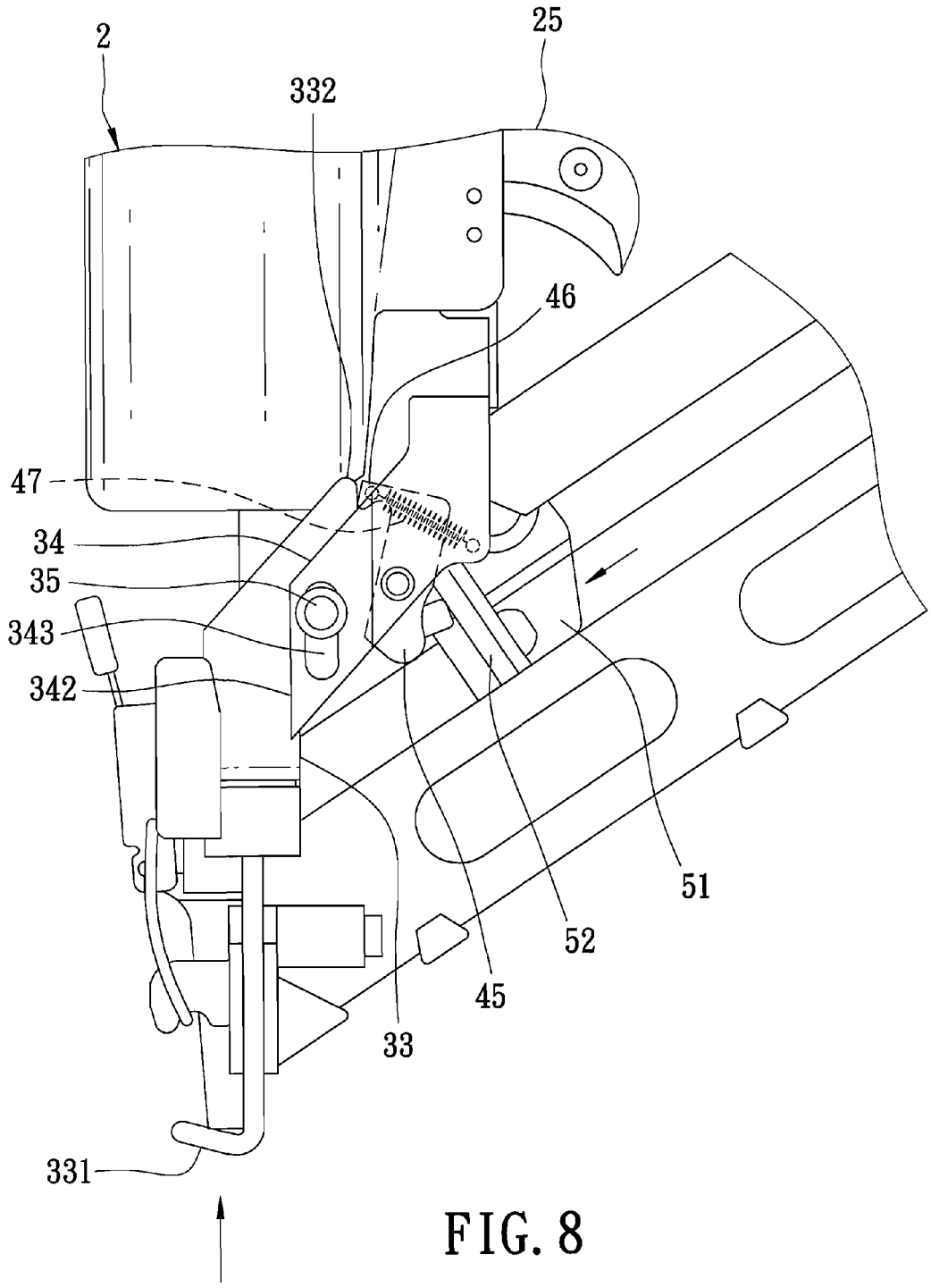
FIG. 8 is a fragmentary, partly exploded schematic front view of the second preferred embodiment, illustrating how a nail-driving operation is prevented when nails are exhausted from a magazine.

FIGS. 6, 7, and 8 show the second preferred embodiment of a nail-driving device according to this invention, which includes a housing 2, a trigger unit 25, a safety unit 3, a connecting unit 4, and a magazine 5. The structures of the safety unit 3 and the connecting unit 4 of this embodiment are different from those of the first preferred embodiment.

In this embodiment, the safety unit 3 includes first and second safety members 33, 34, and a pivot member 35. The first safety member 33 is similar in structure to that of the first preferred embodiment, and has a workpiece-engaging end 331 and a driving end 332. The second safety member 34 is movable relative to the housing 2 along the nail-driving direction (A) to pivot the trigger arm (not shown) of the trigger unit 25, and has a driven end 342 and a slide slot 343 extending along the nail-driving direction (A). The pivot member 35 extends through the slide slot 343 and the driving end 332 of the first safety member 33.

The connecting unit 4 includes a connecting member 45 connected pivotally to the second safety member 34 and having a hook portion 46, and a spring 47 disposed between the connecting member 45 and the second safety member 34. The hook portion 46 constitutes the retaining portion. When the hook portion 46 is disposed in a retaining position shown in FIG. 6, it is biased by the spring 35 to engage a portion of the first safety member 33 so as to prevent relative movement of the first and second safety members 33, 34. As such, with particular reference to FIG. 7, when the workpiece-engaging end 331 of the first safety member 31 is pressed against the workpiece, the first and second safety members 33, 34 move upwardly and synchronously relative to the housing 2 to thereby convert the nail-driving device into a state ready for driving a nail 6.

When nails 6 are exhausted from the magazine 5, the pusher 51 is moved to a retention releasing position shown in FIG. 8. Hence, the projection 52 pivots the connecting member 45 clockwise against the biasing action of the spring 47 to thereby remove the hook portion 46 from the portion of the first safety member 33. In this state, the pivot member 35 is slidable within the slide slot 343. In other words, the second safety member 34 is movable relative to the first safety member 33 so as to prevent the nail-driving device from firing when the workpiece-engaging end 331 of the first safety member 33 is pressed against the workpiece and when the trigger unit 25 is actuated.

Figure 9:
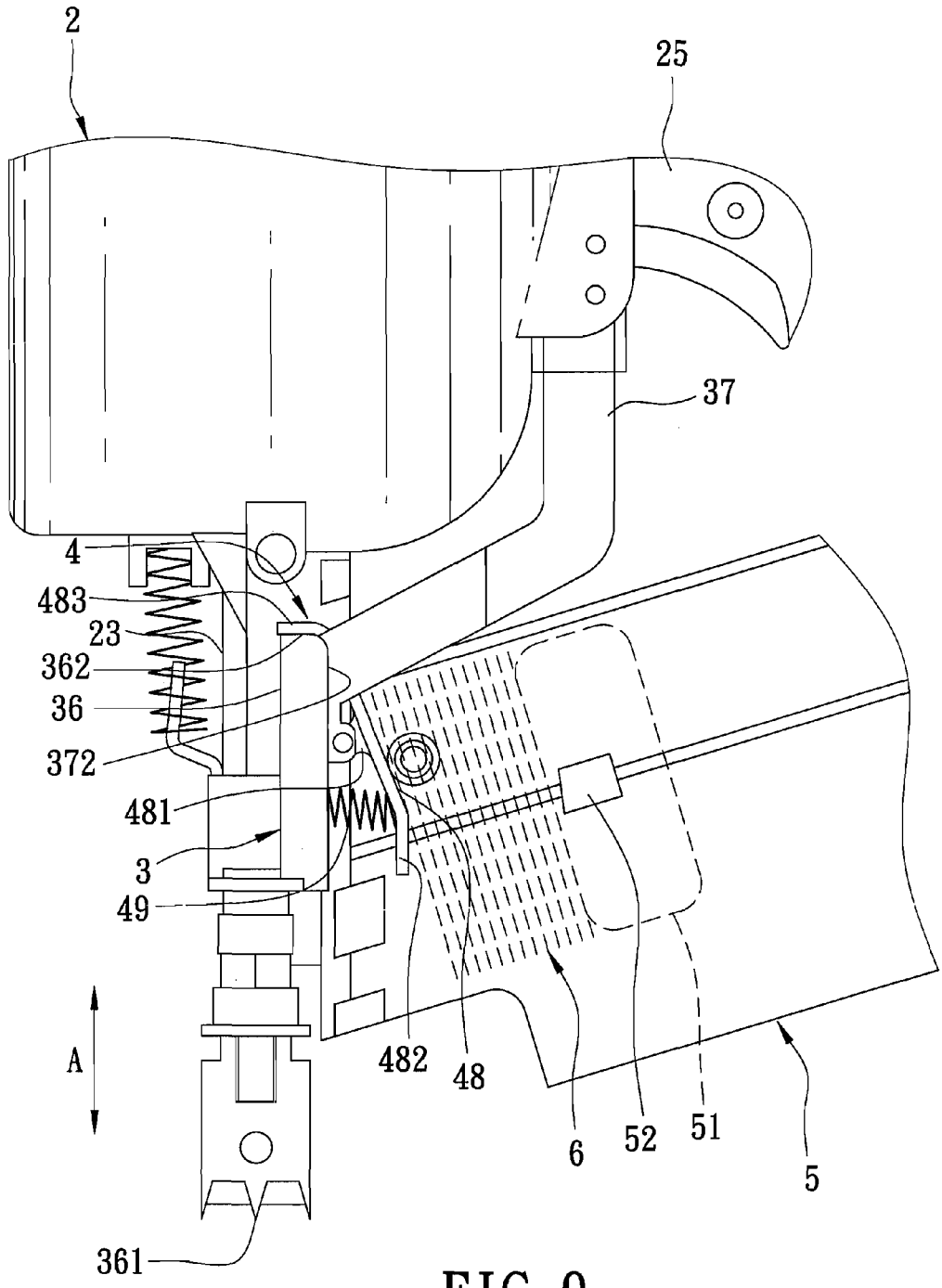
FIG. 9 is a fragmentary, partly exploded schematic front view of the third preferred embodiment of a nail-driving device according to this invention when a retaining portion is disposed in a retaining position.
Figure 10:
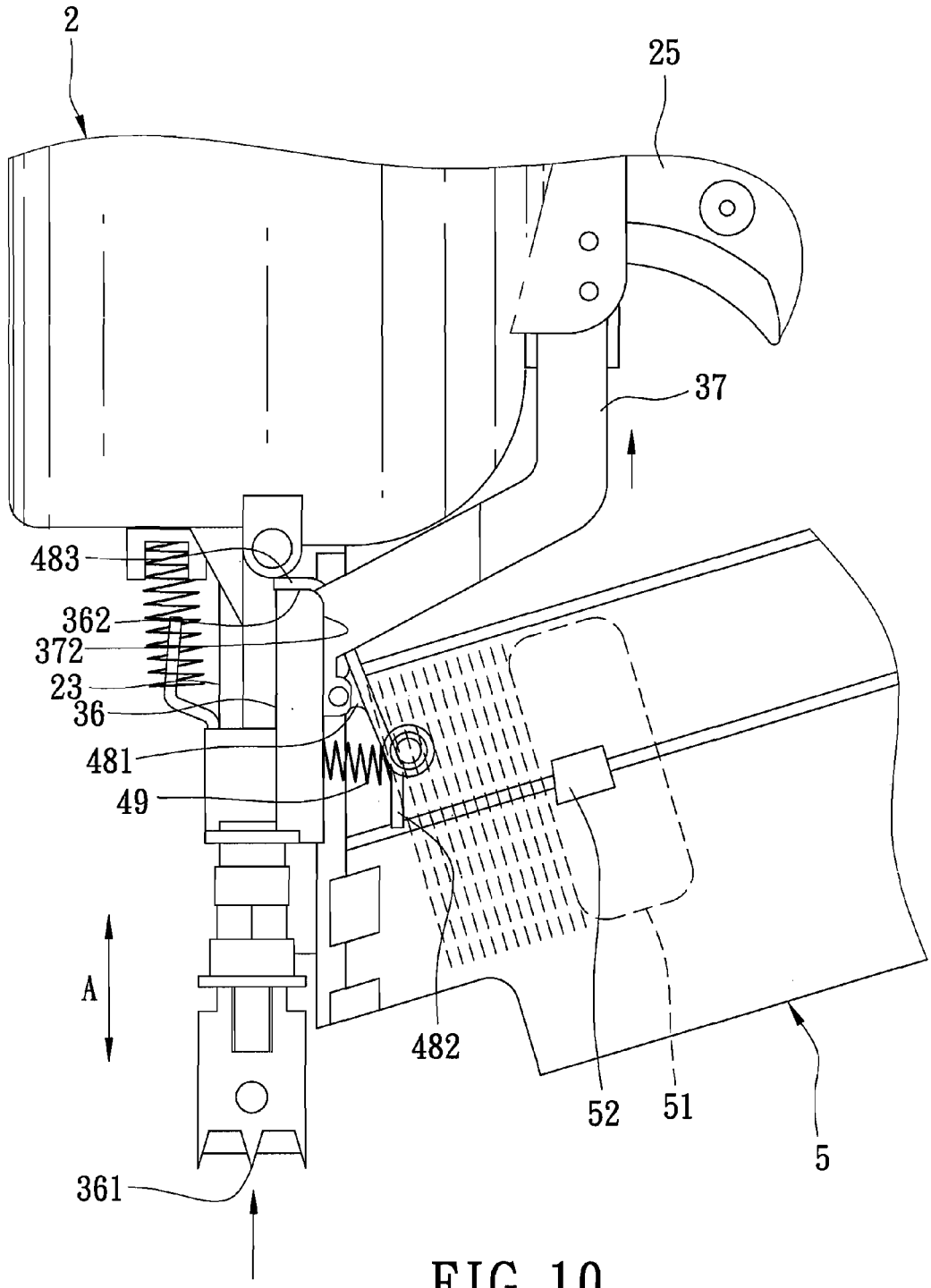
FIG. 10 is a fragmentary, partly exploded schematic front view of the third preferred embodiment in a state ready for driving a nail.
Figure 11:
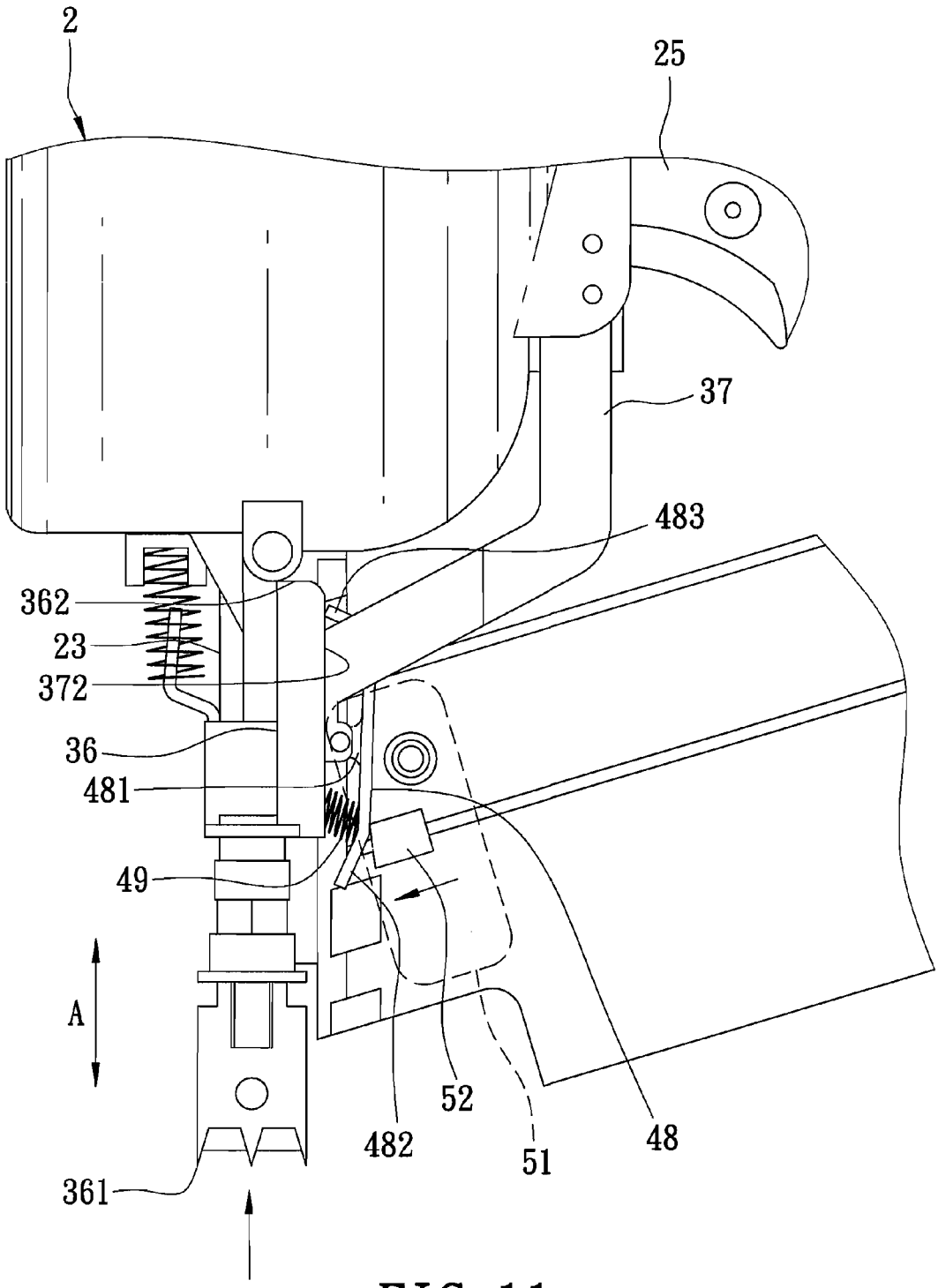
FIG. 11 is a fragmentary, partly exploded schematic front view of the third preferred embodiment, illustrating how a nail-driving operation is prevented when nails are exhausted from a magazine.

FIGS. 9, 10, and 11 show the third preferred embodiment of a nail-driving device according to this invention, which includes a housing 2, a trigger unit 25, a safety unit 3, a connecting unit 4, and a magazine 5. The structures of the safety unit 3 and the connecting unit 4 of this embodiment are also different from those of the first preferred embodiment.

In this embodiment, the safety unit 3 includes first and second safety members 36, 37 movable within the housing 2 between the nail ejection seat 23 and the trigger unit 25. The first safety member 36 has a workpiece-engaging end 361 projecting from the nail ejection seat 23, and a driving end 362 opposite to the workpiece-engaging end 361. The second safety member 37 is movable to pivot the trigger arm of the trigger unit 25, and has a driven end 372 slidable on the driving end 362 of the first safety member 36.

The connecting unit 4 includes a connecting member 48 and a spring member 49. The connecting member 48 has a pivot portion 481 connected pivotally to the second safety member 38, and has a first end 482 and a second end 483 that is opposite to the first end 482 and that constitutes the retaining portion. The pivot portion 481 is disposed between the first and second ends 482, 483. The spring member 49 is configured as a coiled compression spring, and is disposed between the first safety member 36 and the first end 482 of the connecting member 48 for biasing the connecting member 48 to rotate counterclockwise. As such, the second end 483 of the connecting member 48 is biased to contact the driving end 362 of the first safety member 36 so as to prevent relative movement of the first and second safety members 36, 37.

With particular reference to FIG. 10, when the workpiece-engaging end 361 of the first safety member 36 is pressed against the workpiece, the first and second safety members 36, 37 move upwardly and synchronously relative to the housing 2 to thereby convert the nail-driving device into a state ready for driving a nail 6.

When nails 6 are exhausted from the magazine 5, the pusher 51 is moved to a retention releasing position shown in FIG. 11. Hence, a projection 52 of the pusher 51 pivots the connecting member 48 clockwise against the biasing action of the spring member 49 to thereby remove the second end 483 of the connecting member 48 from the driving end 362 of the first safety member 36. In this state, the second safety member 37 is slidable on the first safety member 36 so as to prevent the nail-driving device from firing when the workpiece-engaging end 361 of the first safety member 36 is pressed against the workpiece and when the trigger unit 25 is actuated.

With this invention thus explained, it is apparent that numerous modifications and variations can be made without departing from the scope and spirit of this invention. It is therefore intended that this invention be limited only as indicated by the appended claims.

We claim:

1. A nail-driving device comprising:

a housing;

a trigger unit;

a safety unit including first and second safety members that are disposed movably in said housing;

a connecting unit in said housing, and connected pivotally to said second safety member, and including a retaining portion disposed movably between said first and second safety members and when said retaining portion being in a retaining position whereat synchronous movement of said first and second safety members is allowed and whereat a force is applicable to said first safety member to move said second safety member so as to allow for a nail-driving operation when said trigger unit is actuated; and a magazine connected to said housing and including a pusher adapted to push and move nails in said magazine, wherein when said nails of said magazine are exhausted, said pusher moves to a retention releasing position whereat said connecting unit is pivoted to remove said retaining portion of said connecting unit from said retaining position to thereby allow for relative movement of said first and second safety members so that the nail-driving operation is prevented.

2. The nail-driving device as claimed in claim 1, wherein said housing includes a nail ejection seat adapted to permit the nails to be shot from said nail-driving device therethrough, the first safety member of the safety unit having a workpiece-engaging end that projects from said nail ejection seat of said housing and that is adapted to press against a workpiece such that said first safety member is moved toward said trigger unit.

3. The nail-driving device as claimed in claim 1, wherein said connecting unit further includes a connecting member, a first pivot member, and a second pivot member, said connecting member being formed with a slot and having a slide section and a stop section that is perpendicular to said slide section, that has an end connected to an end of said slide sections, and that constitutes said retaining portion of said connecting unit, said first pivot member extending through said connecting member and said second safety member, said second pivot member extending through said connecting member and said first safety member, said first pivot member engaging the stop section of the slot in the connecting member so as to prevent relative movement of said first and second safety members when said stop section is disposed in said retaining position.

4. The nail-driving device as claimed in claim 3, wherein said pusher of said magazine is formed with a projection that pushes and pivots said connecting member so as to engage said slide section of said slot in said connecting member with said first pivot member, thereby allowing for relative movement of said first and second safety members when said pusher is moved to said retention release position.

5. The nail-driving device as claimed in claim 1, wherein said safety unit further includes a pivot member, said second safety member having a slide slot extending along a nail-driving direction, said pivot member extending through said slide slot in said second safety member; and said connecting unit further includes a connecting member connected pivotally to said second safety member and having a hook portion that constitutes said retaining portion and that engages a portion of said first safety member so as to prevent relative movement of said first and second safety members when said hook portion of said connecting member is disposed in said retaining position, said hook portion of said connecting member being removed from said portion of said first safety member when said pusher of said magazine is disposed in said retention release position.

6. The nail-driving device as claimed in claim 5, wherein said connecting unit further includes a spring disposed between said connecting member and said second safety member for biasing said hook portion of said connecting member to engage said portion of said first safety member.

7. The nail-driving device as claimed in claim 1, wherein said second safety member is slidable on said first safety member, said connecting unit further including a connecting member connected pivotally to said second safety member and having a first end and a second end opposite to said first end and constituting said retaining portion, and a spring member disposed between said first safety member and said first end of said connecting member for biasing said second end of said connecting member to contact said first safety member so as to prevent relative movement of said first and second safety member.

8. The nail-driving device as claimed in claim 7, wherein said pusher of said magazine is formed with a projection movable to contact and pivot said first end of said connecting member against biasing action of said spring member so as to remove said second end of said connecting member from said first safety member.

9. The nail-driving device as claimed in claim 7, wherein said spring member is configured as a coiled compression spring for biasing said first end of said connecting member to move away from said first safety member.

10. The nail-driving device as claimed in claim 1, wherein said trigger unit includes a trigger arm disposed pivotally on said housing and having a free end, said second safety member being biased to contact said free end of said trigger arm such that movement of said second safety member results in pivoting movement of said trigger arm relative to said housing when the force is applied to said first safety member.

* * * * *